United States Patent [19]

Conklin, Jr. et al.

[11] 4,381,691

[45] May 3, 1983

[54] TOUCH FORCE ADJUSTMENT MEANS FOR A PIANO

[75] Inventors: Harold A. Conklin, Jr.; Pieter W. van Nuis, both of Hamilton County, Ohio

[73] Assignee: Baldwin Piano & Organ Company, Cincinnati, Ohio

[21] Appl. No.: 223,756

[22] Filed: Jan. 9, 1981

[51] Int. Cl.[3] ..... G10C 3/12

[52] U.S. Cl. ..... 84/440

[58] Field of Search ..... 84/434, 435, 439, 440

[56] References Cited

U.S. PATENT DOCUMENTS

| | | | |
|---|---|---|---|
| 391,940 | 10/1888 | Brooks | 84/440 |
| 462,636 | 11/1891 | Gibbs | 84/440 |
| 489,564 | 1/1893 | Long | 84/440 |
| 721,706 | 3/1903 | Huseby | 84/434 |
| 2,309,537 | 1/1943 | Rienstra | 84/440 |

*Primary Examiner*—Lawrence R. Franklin

*Attorney, Agent, or Firm*—Frost & Jacobs

[57] ABSTRACT

Means for adjusting the touch force required to depress the keys of a piano within the range normally preferred by pianists, comprising a plurality of spring member means having a relatively small spring constant (low stiffness). Each spring member means is connected at one of its ends to one of piano keys near the fulcrum thereof. Each spring member means is connected at its other end to a beam located above the keys and extending transversely thereof the full length of the keyboard. At least one of the connections of each spring member means is adjustable. The beam may be a single continuous member, or it may be made up of segments corresponding to groups of adjacent keys. In the initial adjustment each spring member means is typically prestressed by means of its adjustable connection to set the static touch force of its respective key to the desired value.

17 Claims, 7 Drawing Figures

TOUCH FORCE ADJUSTMENT MEANS FOR A PIANO

TECHNICAL FIELD

The invention relates to means for adjusting the touch force required to depress the keys of a piano, and more particularly to such means whereby the touch force of all of the keys or of a group of adjacent keys can be changed incrementally and simultaneously, as well as on an individual key basis.

BACKGROUND ART

The teachings of the present invention are applicable to substantially any type of piano including spinets, uprights and the like. For purposes of an exemplary showing, the invention will be described in its application to a grand piano.

In the usual piano action, a felt-covered piano hammer is caused to pivot about a center and strike its respective piano string in response to the force of the player's finger applied near the front end of the corresponding piano key. The rear end of the piano key actuates the hammer operating mechanism, of which there are many types well known in the art. The weight of the piano hammers varies over the scale (a standard piano consisting of 88 keys and hammers) normally from about 10 to 12 grams at the bass end of the scale, to about 3 to 4 grams at the treble end of the scale. The mechanical advantage of the action is less than unity and is such that a displacement of the playing surface of the key of about 9 mm will result in maximum key travel, causing the key to bottom against the felt located beneath its front end, and moving the hammer upward through a vertical distance of the order of 45 mm. This gives a mechanical advantage usually in the range of from about 0.15 to about 0.2. As a result, the force required to depress the key will be several times the weight of the hammer itself, plus an amount representing the weight of the other parts and the internal friction of the piano action. The values of these factors are such that, in the absence of key weights or other compensating devices, the touch force or weight required to just depress the keys might typically range from between about 70 to about 100 grams at the bass end of the keyboard and from about 40 to about 45 grams at the treble end.

Experience has shown that a touch force of from about 70 to about 100 grams is greater than is usually preferred by professional pianists and a touch force of from about 40 to 45 grams is somewhat less than is considered optimum. Surveys over the years have shown that most professional pianists prefer a touch force to be in the range of from about 50 to about 60 grams. Some pianists, however, may prefer a heavier or lighter touch than others, a lighter touch reducing the amount of input work required from the pianist, and a heavier touch providing greater control of the nuances of tone produced by the instrument. In some cases a pianist may prefer a heavier touch for practice and a lighter touch for actual concert performance. There may be occasions too when a different touch would be preferred for different musical compositions, but whatever the preferred value of touch, experience has further shown that pianists generally prefer a constant or nearly constant value of touch force for all the keys of the piano. In other words, it is desirable that the same value of key force or weight should cause any of the keys to descend.

In order to equalize the static touch force or weight of the keys, it has been the usual and conventional prior art practice, in the construction of pianos, to insert lead weights, appropriately positioned, in holes bored in the sides of the piano keys. Typically, these weights weigh about 14 grams each and are approximately cylindrical in shape. In the bass keys, two to five such weights may be required in the front half of each key. In the middle of the keyboard, there may be two or three weights per key. The distance of the weights from the fulcrum of the key is determined so that all of the keys start to descend with approximately the same value of weight or force applied to the playing surface thereof. In the extreme treble, it may be necessary to place the lead weights behind the key fulcrum in order to increase the touch force to the desired value. Thus, to achieve accurate weighting it is necessary to determine the number and optimum position of the weights for each key, individually. This is a time-consuming undertaking, subject to various errors, and after the holes are bored in the keys, it is difficult to correct such errors. Furthermore, as the instrument is used, the hammers will become grooved and it becomes necessary to compensate for this wear by filing away some of the outer felt from the hammers. This, of course, destroys the original accuracy of the weighting. In conventional piano technology there is no practical way to compensate for such changes, or for the change in touch weight that may sometimes accompany changes in ambient relative humidity.

It is important to appreciate that the addition of weights to the keys only compensates statically for the differences in hammer weight between bass and treble hammers. That is, the addition of weights compensates to make the touch force constant only for steady-state or very slowly moving keys. When the piano is played loudly or quickly, the inertial components of force required to accelerate the hammers from rest to some relatively large final velocity make the dynamic input force at the playing surface of the keys much higher than the static force. Although the static force required to raise the hammer may be in the range of from about 50 to about 60 grams, the dynamic key force can be of the order of several kilograms. At these key speeds, the result of adding key weights is to add apparent mass to the key, which makes the touch sensation of finger against key, as the piano is played, different for a piano key having a large number of weights from one with no weights or only a small number of weights. The amount of key inertia apparent to the pianist also depends upon the distance of the weights from the fulcrum of the key. In other words, the use of key weights to compensate for differences in hammer weight has the additional effect of changing the mechanical impedance at the playing surface of the keys so weighted, and does so for each key to an extent that is not independently controllable. As a result, the action may "feel" different to the player, even from one key to the next, depending upon the number and position of weights affixed to each key. From the standpoint of the pianist, this is perhaps the most important disadvantage connected with the current practice of equalizing (static) touch force by means of adding weights to the keys. Nonetheless, it is believed that the concept of normalizing key impedance also, as well as touch force, over the entire keyboard and keeping it from key-to-key within whatever limits prove optimal from the standpoint of the pianist, is not normally considered. In fact, the standard weighting practice makes manipulation of key touch weight and of key impedance impossible, one independently of the other.

Prior art workers have made various attempts at adjusting touch force by means other than key weighting. U.S. Pat. No. 1,866,707 teaches means for adjusting touch force of the individual keys as well as means for collective adjustment of all of the keys. In accordance with the teachings of this reference, each key is provided with a leaf spring affixed to its underside and deflectable by means of an adjustment screw. In addition, a slotted tube extends transversely of the keyboard with the free ends of the key leaf springs inserted into the slot of the tube. The tube is rotatable about its axis within prescribed limits to collectively adjust the touch forces of all of the keys simultaneously. The teachings of this reference have a number of drawbacks. Principal among these are: (1) the use of leaf springs in this configuration is very likely to give the keys an un-piano-like "feel" to the player; (2) static touch weight and dynamic mechanical impedance of a key are not independently controllable in the reference arrangement, and; (3) assembly and disassembly are difficult.

U.S. Pat. No. 2,999,411 is directed to a tensioning device whereby a piano key can be tensioned toward its elevated position to increase the amount of finger force required to depress the key, so as to enable a player to obtain the desired key action. According to this reference, the usually solid piano balance rail fulcrum pin is replaced by a hollow pin having a vertical bore opening at its upper end. A tensioning spring is provided for each key. The tensioning spring comprises a coil of at least one full convolution, from opposite ends of which extend a relatively short vertical arm and a relatively long, generally horizontal arm. The short arm is configured to be received in the balance pin of the key with a frictional fit. The long arm terminates at its free end in an upwardly curved terminal adapted to bear upon the upper surface of the piano key halfway between the balance or fulcrum rail and the capstan. Adjustment of the key action is achieved by vertically shifting the short arm within the hollow balance rail pin. When the short arm is shifted upwardly, spring force of the long arm on the piano key is decreased. Similarly, moving the short arm more deeply into the key supporting pin will increase the force of the long arm upon the piano key. The adjustment means of this reference differs markedly from that of the present disclosure, and no provision is made for adjusting all of the keys, or groups of keys, simultaneously.

The present invention is directed to a touch force adjustment means wherein coil springs (or other compliant members) are used instead of key weights to obtain a constant static touch force from key to key. This is accomplished by prestressing the springs to achieve the desired static key-touch force, as will be described hereinafter. When the springs of the present invention are used to replace the key weights, key impedance can be normalized independently over the entire keyboard and kept within optimal limits from key to key. As will be described hereinafter, the springs are so designed and installed that the change in key force as a result of spring contraction during key playing is essentially negligible. This prevents the action from having an un-piano-like "feel" to the player. The touch force adjustment means of the present invention not only enables adjustment of the individual keys, but also incremental and simultaneous adjustment of all of the piano keys or groups of adjacent piano keys. Furthermore, the touch adjusting mechanism taught herein makes it convenient for the action assembly (consisting of the hammer rail, wippen rail, hammers, wippens, action brackets, and associated parts) to be detached from the keys as a unit, as may be necessary during manufacturing or during piano servicing in the field.

It will be understood that the amount of initial stretch or expansion of the coil springs needs to be different for the various notes of the scale because of the differences in weight between hammers. However, because all of the springs are made to have essentially the same spring constant, the variation in touch weight for each key (when groups of keys are adjusted simultaneously) can be kept nearly the same. Thus, if a 5 gram touch change is desired, a given appropriate adjustment will result in a change of 5 grams on all of the keys adjusted, even though each spring may have a stretched length different from all the others. In order to compensate for differences in key length between the black keys and the white keys, the distances from the key fulcrums to the point of attachment of the springs have been selected to give the same ratio in relation to the key length for all keys. This means that the point of attachment of the springs to the keys will be somewhat closer to the fulcrum for the black keys, than for the white keys, since the black keys are shorter.

Key weights may or may not be used in combination with the touch force adjustment means of the present invention. As will be described hereinafter, there are some instances wherein the use of key weights (for purposes other than equalizing the static touch force or weight of the keys) may be desirable.

DISCLOSURE OF THE INVENTION

According to the invention there is provided means for adjusting the touch force required to depress the keys of a piano within the range normally preferred by pianists, comprising a plurality of coil springs (or other compliant members) having the same relatively low spring constant. In one embodiment, each spring is connected at one of its ends to one of the piano keys near the fulcrum thereof. The other end of each spring is adjustably attached to a beam mounted on the hammer flange rail above the keys and behind the key fulcrums and is adjusted (i.e., prestressed) to provide optimum static key-touch force. In order to prevent lift off of the keys from the fulcrum during any portion of the playing cycle, and to insure smooth key motion and a comfortable touch sensation for the pianist, a key damping system may be added to the keyboard structure. The key damping system comprises a strip of wood or metal located at or very close to the fulcrum pins of the keys and extending across the keyboard. To the bottom of this strip there is attached felt means which can be adjustably pressed down against the tops of the keys, as will be described hereinafter.

In a second embodiment of the invention, the free ends of the springs are adjustably affixed to a beam of suitable material mounted above and in front of the key fulcrums and are adjusted (i.e., prestressed) to provide optimum static key-touch force. In this embodiment, the spring axes are substantially horizontal, rather than being substantially vertical as in the first embodiment.

In both embodiments, the beams to which the springs are adjustably attached can extend the length of the keyboard, or they may be divided into segments, each segment having attached thereto those springs affixed to a group of adjacent keys. In either instance, both ends of the beam, or both ends of a beam segment, are provided with adjustment screws or other appropriate means by which the beam or beam segment can be shifted an equal amount throughout its length, expanding or contracting the springs affixed thereto, to make the touch force for all of the keys (or a group of keys) less or more, as desired.

In both embodiments, some mechanical damping to the springs themselves may be provided to prevent mechanical resonances which might be heard in extremely quiet environments. Furthermore, in both embodiments key weights may or may not be used with the touch force adjustment means. When used, the purpose of the key weights is not to equalize the static touch force or weight of the keys, but rather to provide an optimum mechanical impedance so as to afford the player maximum control of nuance of the music produced, and the greatest playing comfort. In some piano action designs, weights in the rear of the keys at the extreme treble end of the keyboard may be required in order to make it possible to get a full range of touch adjustment.

The touch force adjustment means of the present invention constitute a novel and useful means of improving the response of piano keyboards and of controlling key impedance for optimum subjective responsiveness and comfort.

BEST MODE OF CARRYING OUT THE INVENTION

Figures 1, 2, 3:
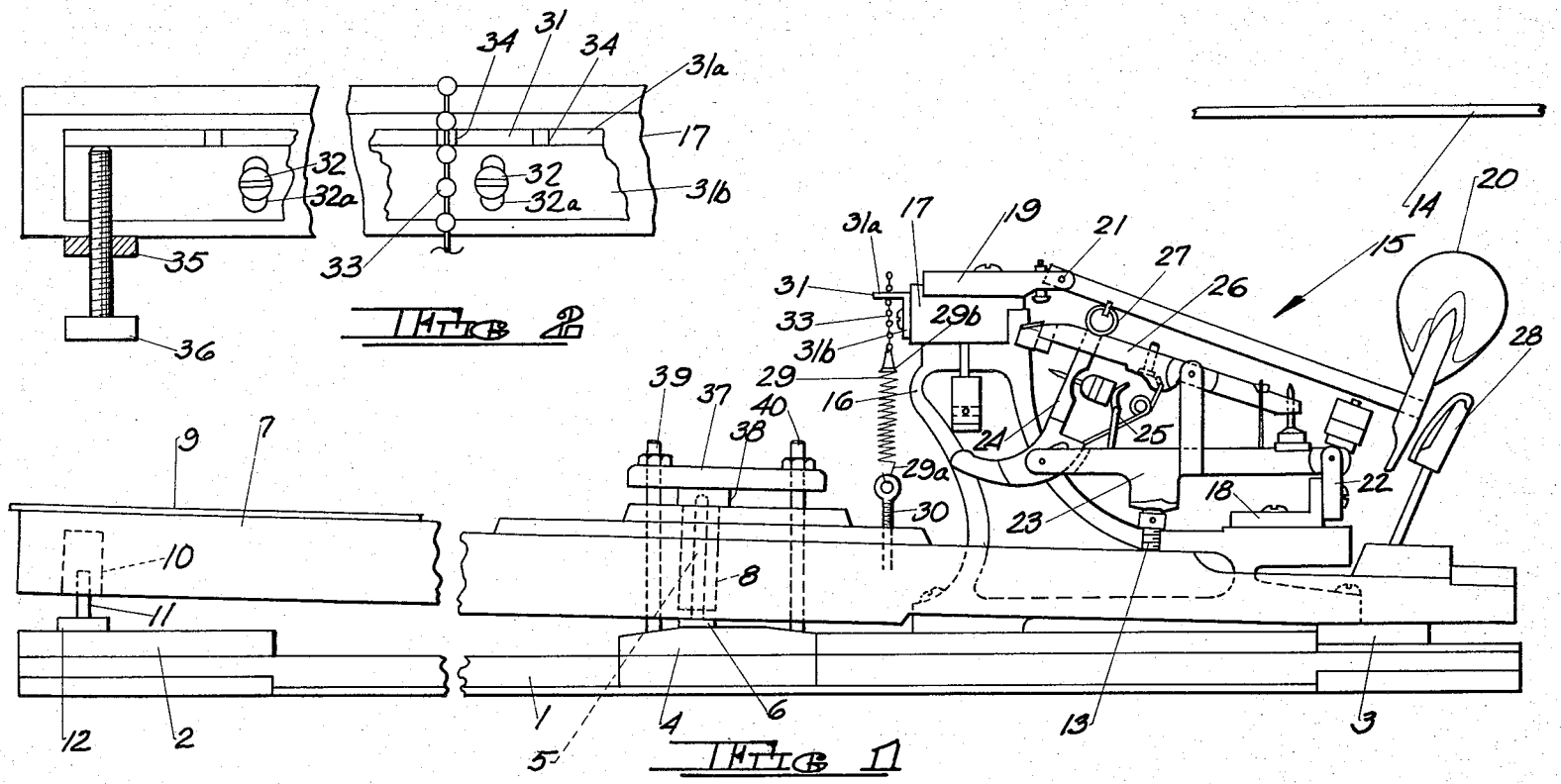
FIG. 1 is a fragmentary, cross sectional view of a grand piano keyboard and action illustrating a key provided with a first embodiment of the present invention.
FIG. 2 is a fragmentary front elevational view of the hammer flange rail of FIG. 1 with the beam of the present invention adjustably affixed thereto and showing the adjustable mounting of the free end of the coil spring to the beam.
FIG. 3 is a fragmentary cross sectional view, similar to FIG. 1, and illustrating a second embodiment of the present invention.

Reference is first made to FIG. 1 which constitutes a cross sectional view through key frame 1, its front rail 2, its rear rail 3 and balance or fulcrum rail 4. Mounted on balance rail 4 there is a fulcrum pin 5, the base of which is surrounded by a felt washer 6. A piano key is shown at 7. Key 7 has a bore 8 receiving fulcrum pin 5. At its forward end, the key is provided with an ivory or plastic key covering 9 and a bore 10 to receive front rail guide pin 11, the base of which is surrounded by a felt washer 12. Near its rearward end, key 7 carries on its upper surface a capstan screw 13.

The key frame and key structure thus far described are conventional. The string associated with key 7 is shown at 14.

Many types of piano actions are known in the art and the type of action used does not constitute a limitation on the present invention. An exemplary piano action for key 7 is indicated generally at 15. For purposes of this invention, the action need not be described in detail. Briefly, the action comprises a plurality of supporting brackets, one of which is shown at 16. The brackets 16 support a hammer flange rail 17 and a wippen flange rail 18. A hammer flange 19 is mounted to hammer flange rail 17. The hammer 20 is pivotally affixed to hammer flange 19, as at 21. Other elements of the action include a wippen flange 22, a wippen 23, a jack 24, a spoon 25, a repetition lever 26, a knuckle 27 and a back check 28 mounted on the key.

The touch force adjustment means of the exemplary embodiment shown comprises a coil spring 29. One end **29*a* of coil spring 29 is engaged in an eye-screw 30 affixed to key 7 behind fulcrum pin 5**.

Adjustably mounted on the front face of hammer flange rail 17 there is a beam 31 which may extend the length of the keyboard. Beam 31 is illustrated as an angle iron, having a horizontal leg **31*a* and a vertical leg 31*b*. The leg 31*b* is in abutment with the front face of hammer flange rail 17 and is adjustably affixed thereto by a plurality of screws, one of which is shown at 32. Beam 31** may be made of any appropriate material and is preferably metallic.

The upper end **29*b* of spring 29 is adjustably affixed to the leg 31*a* of beam 31. This adjustable joinder may be accomplished in any appropriate manner. For example, excellent results have been achieved utilizing a short length of ball or bead chain 33. One end of the ball chain is affixed to end 29*b* of spring 29. The ball chain itself is affixed to the leg 31*a* of beam 31. To this end, the leg 31*a* is provided with slots 34, one for each key. Each slot 34 is of a width sufficient to receive the shank portions of the ball chain 33, but narrower than the diameter of the balls thereof. Similarly, leg 31*a* of beam 31 is of a thickness slightly less than the distance between balls on chain 33. The engagement of ball chain 33 in slot 34 is clearly illustrated in FIG. 2**.

In the embodiment shown in FIGS. 1 and 2, beam 31 runs the length of the keyboard. It will be understood that each key of the piano will be provided with a spring 29 and ball chain assembly 33 affixed thereto by an eye-screw 30. The leg **31*a* of beam 31 will have, as indicated above, a notch 34 for the ball chain of each spring 29. Screws 32, mounting beam 31 to hammer flange rail 17, extend through vertically elongated slots 32*a* in the leg 31*b* of beam 31 so that the beam is shiftable vertically on hammer flange rail 17**.

At each end of beam 31, means are provided to shift the beam upwardly. Again, such means may take any appropriate form. In FIG. 2, one end of beam 31 is shown. Mounted to the underside of hammer flange rail 17 there is a bracket 35 supporting a screw 36. Screw 36 abuts the underside of horizontal leg **31*a* of beam 31**.

There will be a similar bracket 35 and screw 36 assembly at the other end of the beam (not shown).

An initial adjustment of the touch force adjustment means of the present invention will be made at the factory with the action-key assembly removed from the piano. First of all, beam 31 will be shifted by its adjustment screws 36 to its uppermost position. In order to make an initial touch adjustment, a test weight of the desired touch valve (say 50 grams) is placed on the playing surface of the piano key 7. Thereafter, the spring 29 is stretched slowly by means of an upward pull on ball chain 33 until the forward end of the key just starts to move downwardly. At this point, the ball chain is slidably engaged into slot 34 of beam 31. Once inserted, the chain cannot move up or down since slot 34 is of a width less than the diameter of the balls of chain 33. In this way, the amount of expansion or prestressing of spring 29 is fixed at that value to produce the desired touch weight, within a very small tolerance. This same procedure is performed for each of the piano keys. In this way, a constant static touch force from key to key is achieved.

In an exemplary embodiment, ball chain 33 for each key was chosen having balls of about 2 mm in diameter, spaced about four balls per cm. It will be understood that other ball chain sizes could be used.

If the key force were to vary significantly as the key is depressed (due to action of the spring) the action would tend to feel un-piano-like to the player. As a result, all of springs 29 for all of the keys are chosen to have a spring constant which is not only the same, but also as small as feasible, and the springs are prestressed when installed in order to give the desired static key-touch force. In an exemplary embodiment, springs having a spring constant of the order of 0.4 lb/inch (7 grams/mm) were chosen so that the key force will vary only insignificantly as the key is depressed. For example, if the maximum displacement of the key at the point of attachment of spring 29 is only about 2 mm, and thus the variation of spring force due to key travel is approximately $2\times7=14$ grams at the point of attachment of the spring, but only about 3 grams at the front of the key because of its much greater distance from the key fulcrum, the change in key force as a result of the 2 mm spring contraction assumed is essentially negligible in comparison to the initial key-touch force.

In order to vary the touch of all of the keys without having to reset each individual spring 29-ball chain 33 assembly, it is only necessary to shift beam 31 upwardly or downwardly by means of its adjustment screws 36. When the adjustment screws 36 at both ends of beam 31 are turned by equal amounts and in the same direction to cause the beam to shift downwardly with respect to the hammer flange rail 17 by an equal amount throughout its length, the touch force of all of the keys will be increased by essentially an equal amount. Upward shifting of beam 31 uniformly throughout its length will cause the touch force of all of the keys to decrease by essentially the same amount similarly.

Piano actions are normally constructed in sections, each section comprising from about 15 to about 30 notes (i.e. from about 15 to about 30 adjacent keys of the keyboard). It is within the scope of the present invention to divide beam 31 into separate segments, each segment corresponding to a section of the keyboard with all of the keys of that section having their spring 29 and ball chain 33 assembly affixed to their respective segment of beam 31. Under these circumstances, each end of each segment must be provided with an adjustment screw 36. When this is done, the touch of each group of keys may be adjustable as a group, rather than adjusting the touch of all of the keys of the piano simultaneously. Whether beam 31 is a unitary, one-piece structure, or is made up of individual segments, it will be evident from FIG. 1 that the touch force adjusting mechanism of the present invention may be readily removed from the hammer flange rail 17 by removal of screws 32, to make it convenient for the action assembly (consisting of the hammer rail 17, wippen rail 18, hammers 20, wippens 23, action brackets 16 and associated parts) to be detached from the keys as a unit, as may be necessary during manufacturing or servicing in the field.

It will be understood that the amount of stretch or expansion of the coil springs 29 will be different for the various notes of the scale due to the difference in weight of their respective hammers. However, because all of the springs have essentially the same spring constant, the variation in touch weight for each key (when all or groups of keys are adjusted simultaneously by raising or lowering the beam 31 or segments thereof) will be the same. That is, if a 5 gram touch change is desired, a given displacement of beam 31 or a segment thereof will result in a change of 5 grams on all of the keys attached to the beam or segment thereof, even though each spring may have a stretched length different from all of the others. To assist in adjustment of the keys, screws 36 may be calibrated in grams of touch force.

In this embodiment of the invention, the location of the eye screws 30 along a line approximately underneath the forward edge of the hammer flange rail 17 is a matter of convenience for easily connecting the springs 29 to beam 31. Through appropriate spring design, it would be possible to achieve acceptable operation with the springs connected to the keys at almost any point behind the balance rail 4. A softer, stretchier spring would be needed if the attachment point were farther back toward the end of the key 7, so that the variation of touch force through the keystroke could be kept the same as for a position nearer to the balance rail. Locating eye screws 30 is well within the skill of the worker in the art, depending upon the nature of the piano action with which he is working and the design or selection of the springs to be used.

In order to compensate for the differences in key length between the black keys and the white keys, the distances from the key fulcrums 5 to eye-screws 30 have been selected to give the same ratio in relation to key length for all of the keys. This means that the position of eye-screws 30 will be somewhat closer to the fulcrum 5 for the black keys than for the white keys, since the black keys are shorter.

In the embodiment just described with respect to FIGS. 1 and 2, the action of spring 29 not only lightens the touch of key 7, but also reduces the load of the key against fulcrum washer 6. This reduces the rate of "settling" of key 7 or deformation of fulcrum washer 6, which normally occurs in a new piano. However, in some cases, enough of the effective weight of the key 7 may be neutralized by the action of spring 29, that key 7 may actually tend to lift off the fulcrum pin 5 during some portion of a vigorous stroke of the key. To prevent this, and to insure smooth key motion and comfortable touch sensation for the pianist, it has been found helpful to add some damping to the key system.

Referring again to FIG. 1, this damping is accomplished by means of a strip of wood or metal located above the keys and extending transversely thereof throughout the length of the keyboard. Damping strip 37 is located close to fulcrum pin 5. To the bottom of damping strip 37 there is mounted felt means 38 which is adjustably pressed down against the top of key 7 and all of the other keys. Instead of being a continuous strip of felt, the element 38 may consist of a plurality of felt washers, one for each key. Each washer is so located that its center hole accepts the upper end of its respective fulcrum pin 5, placing the felt washer in contact with the top of the key. Damping strip 37 is supported by pairs of support posts 39 and 40 located at intervals along the strip. By adjusting support posts 39 and 40, the amount of pressure applied by felt element 38 against the top of key 7 (and all of the other keys) can be adjusted. Damping strip 37 differs from a conventional "key strip", well known in the art, in that the conventional key strip does not contact the keys and is intended only to prevent the keys from coming off their respective fulcrum pins during playing, in case the pianist's finger catches the overhang of key covering 9 at the front of the key, or during transport or shipping of the piano. The conventional key strip performs no damping function in its normal use, since it is not intended to contact the keys.

It will be understood by one skilled in the art that coil springs 29 could be replaced by other forms of longitudinally stretchable, resilient elements, so long as the elements can be so chosen as to have an appropriate spring constant, as described above.

A second embodiment of the present invention is illustrated in FIGS. 3 through 7. In these Figures, like elements described with respect to FIGS. 1 and 2 have been given like index numerals.

Referring to FIG. 3, a beam 41 is provided extending transversely of the keys, the length of the keyboard. Beam 41 is supported at its ends, as will be described hereinafter. The beam is located above the keys and forwardly of fulcrum pin 5, as shown. At its forward end (that end facing the front of the piano) the beam 41 is provided with an upstanding flange 42 having formed therein a plurality of notches equivalent to notches 34 in beam 31 of FIG. 2. One such notch is shown in FIG. 3 at 43. It will be understood that the beam flange 42 will have a notch 43 for each key of the keyboard.

As in the embodiment of FIGS. 1 and 2, spring 29 is provided for each key and is affixed to key 7 at its end **29*a* by means of eye-screw 30. At its other end 29*b*, spring 29 has affixed thereto ball chain 33. The free portion of ball chain 33 is adapted to be received in the slot 43 of beam flange 42, as shown in FIG. 3**.

In contrast to the embodiment of FIG. 1, wherein spring 29 is oriented substantially vertically, in the embodiment of FIG. 3 spring 29 is substantially horizontal and extends approximately parallel to the direction of the keys. Again, the eye-screw 30 is located behind fulcrum pin 5 and in this embodiment the distance from fulcrum pin 5 to eye screw 30 is a matter of design choice. In this configuration, the purpose of the spring is again to provide a moment (force x lever arm distance) which tends to counteract the moment produced by the force of the wippen 23 against the capstan screw 13. The moment arm can be made slightly adjustable by turning the eye-screw 30 into or out of the key. The greater the height above the key of the attachment point of the end **29*a* of spring 29, the longer the lever arm. It is desirable to afford the sharps (black keys) somewhat shorter lever arms than the naturals (white keys) in order to compensate for the fact that the length of the black keys is less than that of the white keys. As a result, the eye-screws 30 of the black keys may be set to protrude a lesser distance above the top surface of the keys than those of the white keys. The horizontal distance from the fulcrum pin 5** to the point of attachment does not affect the moment in this case.

Figures 4, 5, 7:
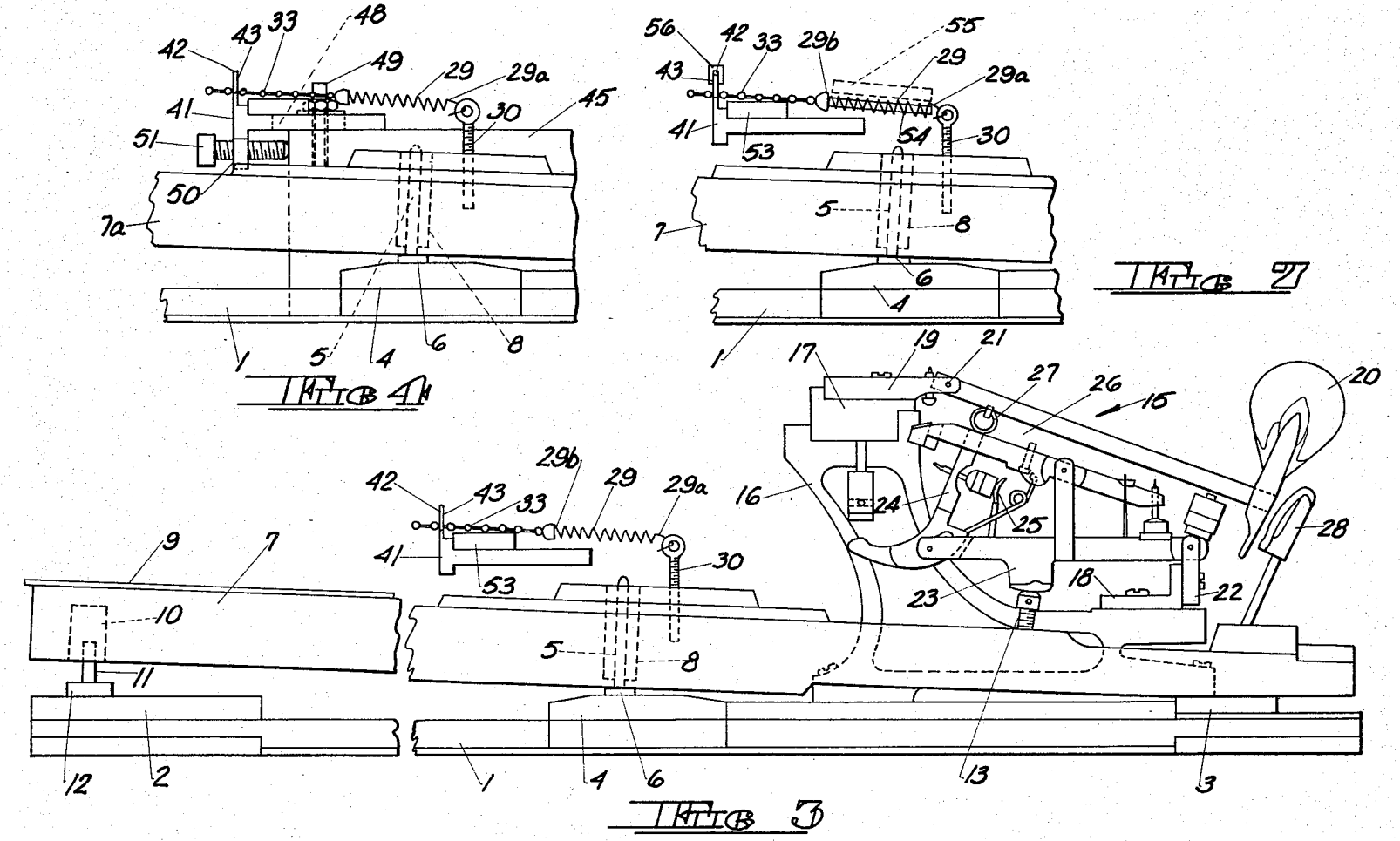
FIG. 4 is a fragmentary cross sectional view, similar to the central portion of FIG. 3, and illustrating the endmost key of the keyboard together with support and adjustment means for the touch force adjustment means beam.
FIG. 5 is a semi-diagrammatic plan view of the key frame, illustrating the adjustable mounting of the ends of the touch force adjustment beam.
FIG. 7 is a fragmentary cross section view of the central portion of FIG. 3, illustrating the use of a cover strip to prevent the ball chains from coming out of their respective slots when the piano is shipped or transported, and the use of spring damping means.
Figures 5, 6:
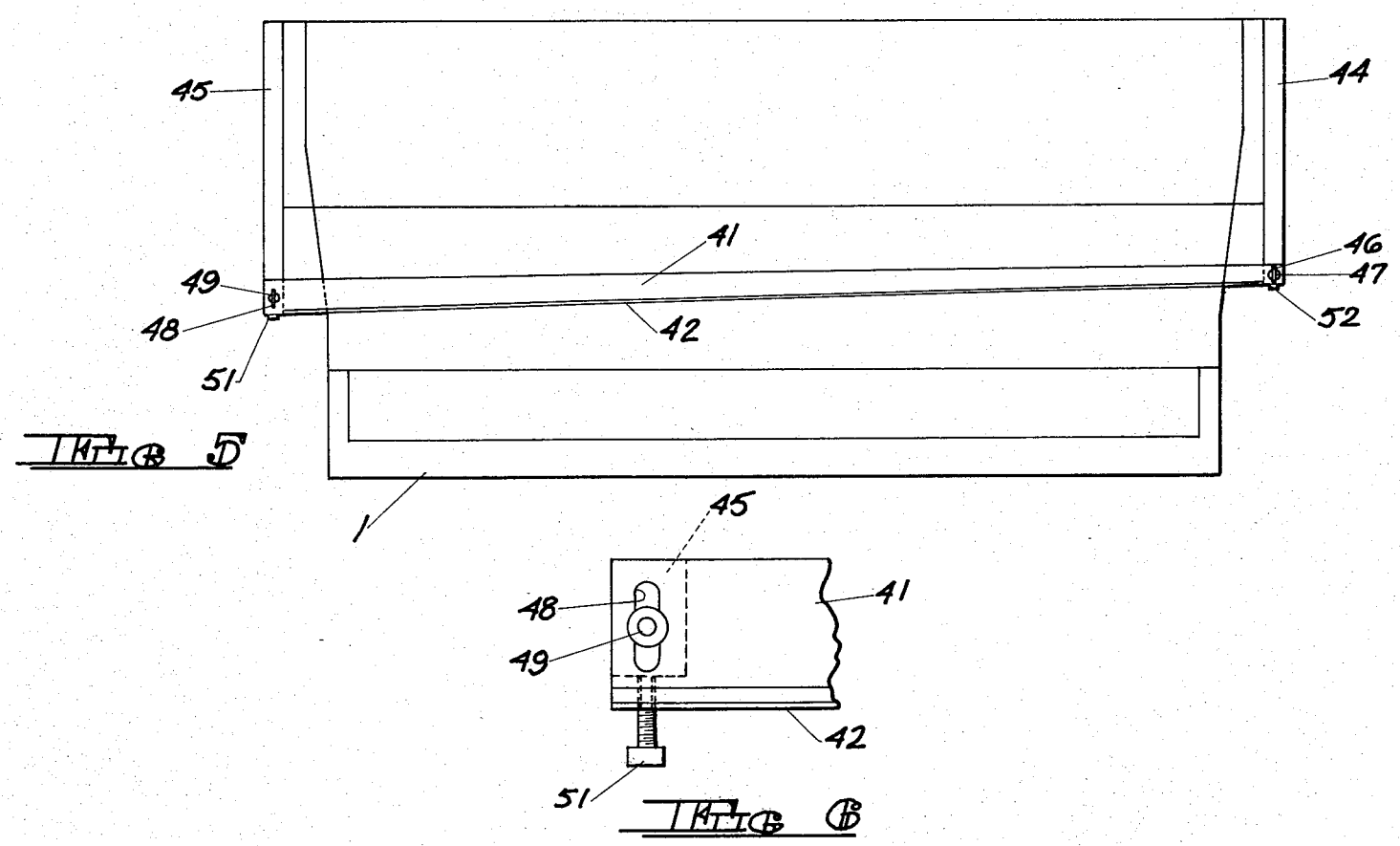
FIG. 6 is a fragmentary plan view illustrating the adjustment means at the left hand end of the beam, as seen in FIG. 5.

Reference is now made to FIGS. 4, 5 and 6. FIG. 5 is a semi-diagrammatic view of key frame 1. At its ends, the key frame is provided with upstanding brackets 44 and 45. FIG. 4 is similar to FIG. 3, but is a cross section view through the keyboard assembly showing the key nearest bracket 45 and illustrating bracket 45 as well.

It will be seen that the upper surface of bracket 45 is substantially horizontal. The ends of beam 41 rest upon the upper surface of brackets 44 and 45. The end of beam 41, resting upon bracket 44, is provided with an elongated slot 46 through which a screw nut and washer assembly 47 extends. Similarly, the end of beam 41 resting on bracket 45 is provided with an elongated slot 48 through which a threaded screw, nut and washer assembly 49 extends. The provision of elongated slots 46 and 48 enable the beam to shift rearwardly and forwardly with respect to brackets 44 and 45 as will be most clearly understood from FIGS. 4 and 6.

Beam 41 is made of suitably rigid material such as aluminum, steel or the like. Near that end of beam 41 resting upon bracket 45, the beam has a downwardly depending flange 50 adapted to support a threaded adjustment screw 51. As will be evident from FIGS. 4 and 6, the forward end of screw 51 abuts the forward surface of bracket 45. An identical arrangement will be provided at that end of beam 41 resting upon bracket 44. An adjustment screw 52, similar to adjustment screw 51 is shown in FIG. 5. As in the case of adjustment screw 36 of FIG. 2, the screws 51 and 52 may be calibrated in grams of touch force.

Beam 41 is designed and positioned so that, when it is adjusted to its furthest forward position (toward the front or playing surface of the keys), there is no interference between the beam 41 and the fall board or name board (not shown) of the piano.

As in the case of the embodiment of FIGS. 1 and 2, an initial factory adjustment is made in the touch force adjusting means of this embodiment. This is accomplished by locating the beam in its furthest forward position by means of screws 51 and 52. Thereafter, each spring 29 of each key is affixed to beam 41, having been stretched to the point where the keys will just start to descend with the smallest desired weight applied to their playing surfaces (say 45 grams). This is accomplished by pulling the ball chain 33 of each spring 29 until its respective key starts to move. Then, the chain is latched in the nearest slot 42 as shown in FIGS. 3 and 4. Subsequent adjustment to make the touch heavier, if desired, is accomplished by turning both of screws 51 and 52 by an equal amount to cause beam 41 to shift rearwardly. This changes the touch of each key by the same number of grams.

In the embodiment of FIGS. 3 through 7, no additional key damping is normally required, as in the first embodiment of FIGS. 1 and 2, because no component of spring force acts to lift the keys up and away from fulcrum rail 4. An advantage of the touch force adjustment means of FIGS. 3 through 7 lies in the fact that the piano action elements supported by action brackets 16 can be removed from the key frame as a unit, without the necessity of disconnecting any of the touch adjustment parts from the action rails.

As is shown in FIGS. 3 and 7, a strip of felt 53 may be located on beam 41 beneath the ball chain 33 for each key to prevent metal-to-metal contact between the ball chain 33 and beam 41 which might produce extraneous noise during the playing of the instrument. It may also be desirable to add some mechanical damping to the springs themselves to prevent resonances which might be heard in extremely quiet environments. Suitable damping could be obtained by inserting a length of felt 54 (see FIG. 7) inside the helix of each spring. Alternatively, each spring could be sprayed or coated with a plastic or other appropriate material which, after setting, would leave a thin coating of damping material on the coils of the spring. As yet another alternative, a strip of felt could be positioned over all of the springs. Such a strip of felt is shown in FIG. 7 in broken lines at 55. Similar spring damping expedients may be practiced with respect to the embodiment of FIGS. 1 and 2. In the embodiment of FIGS. 3 through 7, it would be desirable to provide means to prevent disengagement of the ball chains 33 of the keys from beam 41 during shipping or transport of the piano. An exemplary means to accomplish this is shown in FIG. 7 and comprises a simple channel member 56 of resilient material such as plastic or rubber which will frictionally engage the edge of beam flange 43 maintaining chains 33 in their slots 42.

As in the case of the embodiment of FIGS. 1 and 2, the springs 29 of the embodiment of FIGS. 3 through 7 could be replaced by some other suitable longitudinally stretchable material, so long as the material can be so selected as to have the same small spring constant described above.

Key weights may or may not be used in combination with either embodiment of the touch force adjustment means described above. Mechanical impedance of the key (which determines the touch sensation received by the pianist's fingers during playing) is affected by a number of factors within the action key system, including the presence or absence of key weights, their number and locations. From an energy efficiency standpoint, elimination of the weights reduces the amount of energy input required from the pianist to the piano in order to produce a given sound output, thus making the piano playing process more efficient. However, from the pianist's standpoint, the highest possible efficiency may or may not be consistent with the best achievable technique. Therefore, it may be desirable to use some weights in the keys, not in order to adjust the touch force, but in order to provide an optimum mechanical impedance so as to afford the player maximum control of nuance of the music produced, and the greatest playing comfort.

Typically, it might be desirable to use one or two 14 gram weights in the bass keys, perhaps one weight in some of the middle keys, all weights being located near the front of the keys to produce maximum moment of inertia. In the extreme treble end of the keyboard, it may be desirable to use one or two such weights at the back of the keys, while some intermediate keys are not provided with weights. Distribution of weight may be adjusted to produce maximum playing comfort and control for all instruments of a given design. An auxiliary result will be to make more uniform (from end-to-end of the keyboard) the amount of spring extension needed to produce a constant touch force. Also, weights in the rear of the keys at the extreme treble end of the keyboard may be necessary in order to make it possible to achieve a full range of touch adjustment, since, even without any weights or springs, the touch at the treble end of the keyboard may be as light as 45 or 50 grams.

Modifications may be made in the invention without departing from the spirit of it. For example, in the embodiments described a plurality of identical, longitudinally stretchable, coil springs are used. It will be understood by one skilled in the art that a working action could easily be designed utilizing springs scaled to different sizes from one end of the keyboard to the other.

While coil springs represent convenient and readily available compliant members for use in the embodiments of the present invention, other types of compliant members might be used including rubberized cords, hair-pin shaped springs, leaf springs and the like. In essence, what is needed is a compliant member whose restoring force remains essentially constant as it is stretched enough to allow for deflection of the piano key. The compliant member must also be capable of being prestressed to obtain the desired static key-touch force.

In the embodiments taught above, each spring is stretched between its key and a support above the key in such a manner that adjustment of the stress upon the spring can be made at its connection to the support. It would be within the scope of the invention to make the connection of the spring to its key adjustable so that the adjustment could be made at the connection to the key rather than at the connection to the support, or at both connections.

It would also be within the scope of the invention to utilize a compressed spring force, applied on the other side of the fulcrum, or on the underside of the key. Under these circumstances a solid drive rod with notches or bumps, instead of a chain with balls, could be used.

The use of coil springs having a linear force-displacement characteristic ensures that collective adjustment will provide a nearly uniform result across the scale if the ends of the beam are moved the same distance, or a smoothly graduated result if the ends of the beam are moved different distances.

While it is preferred that the support be shiftable (as taught above) so that touch force adjustment for all of the keys can be made simultaneously, the present invention is intended also to encompass a situation wherein the support above the keys is non-shiftable. In such a situation the springs do serve as a means to eliminate the inertia of key weights and to facilitate adjustment of key touch force with a minimum of labor.

What is claimed is:

1. A touch force adjustment means for a piano playing key of the type adapted to operate a hammer action, said touch force adjustment means comprising a spring member means, said spring member means being connected to said key and being connected to a means located above said key, one at least of said connections being adjustable said spring member means being prestressed in tension by means of said adjustable connection to reduce said touch force of said key.

2. The structure claimed in claim 1 wherein said means located above said key is shiftable so as to change said touch force for said key by changing the stress on said spring member means.

3. A touch force adjustment means for the playing keys of the keyboard of a piano, said keys each being of the type adapted to operate a hammer action, said touch force adjustment means comprising a spring member means for each key, each spring member means being connected to its respective key and being connected to a means located above and extending transversely of said keys, one at least of said connections for each of said springs being adjustable, each of said spring members being prestressed by means of its adjustable connection to reduce said touch force of its respective key, said means above said key being shiftable to change said touch force adjustment for said keys by changing the stress on said spring member means simultaneously.

4. The structure claimed in claim 3 wherein said spring member means comprises a coil spring having a first end connected to said key and a second end adjustably connected to said means above said key, said coil spring being capable of said prestressing and having a small spring constant such that the change in touch force during the travel of said key is negligible.

5. The structure claimed in claim 3 wherein each key has a fulcrum, each spring member means having a first end connected to its respective key near and behind said fulcrum thereof, said means located above and extending transversely of said keys comprising a beam extending the length of said keyboard, each of said spring member means having a second end adjustably connected to said beam, and means to shift said beam throughout its length to increase and decrease the touch force of all of said keys.

6. The structure claimed in claim 5, wherein said spring member means comprise coil springs having substantially the same small spring constant such that the change in key force as a result of spring stretching is negligible and such that the variation in touch force for each key will be essentially the same when the keys are adjusted simultaneously by shifting said beam.

7. The structure claimed in claim 6 wherein said beam is located behind said key fulcrums, the axes of said coil springs being substantially vertical.

8. The structure claimed in claim 7 including key damping means comprising an elongated strip extending transversely of said key the length of said keyboard, felt means mounted on the underside of said strip and contacting said keys adjacent said fulcrums thereof, and adjustable means to support said strip and to adjust the contact pressure of said felt means against said keys.

9. The structure claimed in claim 6 wherein said means to shift said beam comprises an adjustment screw at each end of said beam.

10. The structure claimed in claim 6 wherein said beam is located ahead of said key fulcrums, the axes of said coil springs being substantially horizontal.

11. The structure claimed in claim 6 including damping means for said coil springs.

12. The structure claimed in claim 6 wherein said second end of said coil spring terminates in a length of ball chain made up of alternate balls and shanks, said beam having a slot therein for each coil spring, each of said slots being so dimensioned as to receive any shank of the ball chain of its respective coil spring between adjacent balls thereof.

13. The structure claimed in claim 6 wherein said beam is divided into separate segments corresponding to groups of adjacent keys, said coil springs for the keys of a group having their second end adjustably connected to said beam segment corresponding to said group, and means to shift each segment individually throughout its length to simultaneously increase and decrease the touch force of all of said keys of its respective group thereof.

14. The structure claimed in claim 13 wherein said means to shift each beam segment comprises an adjustment screw located at each end of said beam segment.

15. The structure claimed in claim 5 wherein said means to shift said beam comprises an adjustment screw at each end of said beam.

16. The structure claimed in claim 5 wherein said beam is divided into separate segments corresponding to groups of adjacent keys, said spring members means for the keys of a group having their second ends adjustably connected to said beam segment corresponding to said group, and means to shift each segment individually throughout its length to simultaneously increase and decrease the touch force of all of said keys of its respective group thereof.

17. The structure claimed in claim 16 wherein said means to shift each beam segment comprises an adjustment screw located at each end of said beam segment.

* * * * *